US007258751B2

(12) United States Patent
Tomizawa et al.

(10) Patent No.: US 7,258,751 B2
(45) Date of Patent: Aug. 21, 2007

(54) RARE EARTH MAGNET AND METHOD FOR PRODUCTION THEREOF

(75) Inventors: Hiroyuki Tomizawa, Hirakata (JP); Yuji Kaneko, Uji (JP)

(73) Assignee: Neomax Co., Ltd., Osaka (JP)

( * ) Notice: Subject to any disclaimer, the term of this patent is extended or adjusted under 35 U.S.C. 154(b) by 454 days.

(21) Appl. No.: 10/480,309

(22) PCT Filed: Jun. 19, 2002

(86) PCT No.: PCT/JP02/06134

§ 371 (c)(1),
(2), (4) Date: Dec. 11, 2003

(87) PCT Pub. No.: WO03/001541

PCT Pub. Date: Jan. 3, 2003

(65) Prior Publication Data

US 2004/0163737 A1 Aug. 26, 2004

(30) Foreign Application Priority Data

Jun. 22, 2001 (JP) ..... 2001-189673

(51) Int. Cl.
*H01F 1/057* (2006.01)

(52) U.S. Cl. ..... 148/101; 148/302; 164/463; 164/477

(58) Field of Classification Search ..... None
See application file for complete search history.

(56) References Cited

U.S. PATENT DOCUMENTS 5,181,973 A 1/1993 Hirose et al.
5,383,978 A 1/1995 Yamamoto et al.
5,411,608 A 5/1995 Hazelton et al.
5,908,513 A 6/1999 Sasaki et al.
6,322,637 B1 11/2001 Hirota et al.
6,403,024 B1 6/2002 Oota et al.
6,491,765 B2 12/2002 Okayama et al.
2006/0016515 A1 * 1/2006 Tomizawa et al. ..... 148/101

FOREIGN PATENT DOCUMENTS

JP 60-145357 7/1985

(Continued)

*Primary Examiner*—John P. Sheehan
(74) *Attorney, Agent, or Firm*—Nixon Peabody LLP; Jeffrey L. Costellia

(57) ABSTRACT

In a rare earth magnet, an added heavy rare earth element $R_H$ such as Dy is effectively used without any waste, so as to effectively improve the coercive force. First, a molten alloy of a material alloy for an R-T-Q rare earth magnet (R is a rare earth element, T is a transition metal element, and Q is at least one element selected from the group consisting of B, C, N, Al, Si, and P), the rare earth element R containing at least one kind of element $R_L$ selected from the group consisting of Nd and Pr and at least one kind of element $R_H$ selected from the group consisting of Dy Tb, and Ho is prepared. The molten alloy is quenched, so as to produce a solidified alloy. Thereafter, a thermal treatment in which the rapidly solidified alloy is held in a temperature range of 400° C. or higher and lower than 800° C. for a period of not shorter than 5 minutes nor longer than 12 hours is performed. By the thermal treatment, the element $R_H$ can be moved from the grain boundary phase to the main phase, so that the coercive force is increased.

10 Claims, 4 Drawing Sheets

FOREIGN PATENT DOCUMENTS

| | | |
|---|---|---|
| JP | 61-253805 | 11/1986 |
| JP | 02-298003 | 12/1990 |
| JP | 03-222304 | 10/1991 |
| JP | 05-033076 | 2/1993 |
| JP | 06-096928 | 4/1994 |
| JP | 06-124824 | 5/1994 |
| JP | 08-264363 | 10/1996 |
| JP | 09-017677 | 1/1997 |
| JP | 10-102215 | 4/1998 |
| JP | 10-289813 | 10/1998 |
| JP | 2001-059144 | 3/2001 |
| JP | 2001-060504 | 3/2001 |
| JP | 2001-155913 | 6/2001 |

* cited by examiner

RARE EARTH MAGNET AND METHOD FOR PRODUCTION THEREOF

TECHNICAL FIELD

The present invention relates to a rare earth magnet, and a production method thereof.

BACKGROUND ART

Presently, two kinds of rare earth magnets: samarium/cobalt-based magnet, and a neodymium/iron/boron-based magnet are widely used in various fields. The neodymium, iron/boron-based magnet exhibits the highest magnetic energy product of various kinds of magnets, and the price thereof is relatively low, so that the neodymium/iron/boron-based magnet is positively adopted in various electronic equipments.

The neodymium/iron/boron-based magnet is a magnet having $Nd_2Fe_{14}B$ crystals as a main phase, and, in some cases, the magnet is more generally referred to as "an R-T-B magnet" Herein, R is a rare earth element and/or Y (yttrium), T is mainly Fe and a transition metal represented by Ni and Co, and B is boron. An element such as C, N, Al, Si, and/or P can be substituted for part of B, so that, in this specification, at least one element selected from the group consisting of B, C, N, Al, Si, and P is denoted by "Q", and a rare earth magnet referred to as "a neodymium/iron/boron-based magnet" is widely referred to as "an R-T-Q rare earth magnet". In the R-T-Q rare earth magnet, $R_2T_{14}Q$ crystal grains constitute a main phase.

Powder of a material alloy for the R-T-Q rare earth magnet is often prepared by a method including a first pulverization process in which the material alloy is coarsely pulverized, and a second pulverization process in which the material alloy is finely pulverized. For example, in the first pulverization process, the material alloy is coarsely pulverized so as to have a size of several hundreds of micrometers or less by hydrogen decrepitation process. Thereafter, in the second pulverization process, the coarsely-pulverized material alloy (coarsely-pulverized powder) is finely pulverized so as to have an average particle diameter of about several micrometers by means of a jet mill pulverization apparatus, or the like.

There are two general kinds of methods for preparing a material alloy for a magnet. The first method is an ingot casting method in which a molten alloy of predetermined composition is put into a casting mold, and is relatively slowly cooled. The second method is a rapid solidification method represented by a strip casting method, a centrifugal casting method, or the like in which a molten alloy of predetermined composition comes into contact with a single roll, a twin roll, a rotating disk, a rotating cylindrical casting mold, or the like, and is rapidly cooled, so that a solidified alloy thinner than an ingot alloy is prepared from the molten alloy.

In the case of the rapid solidification method, the cooling speed of the molten alloy is in the range of, for example, not less than $10^{1\circ}$ C./sec. nor more than $10^{4\circ}$ C./sec. The thickness of the quenched alloy prepared by the rapid solidification method is in the range of not less than 0.03 mm nor more than 10 mm. As for the molten alloy, a face thereof which is brought into contact with a cooling roll (a roll contact face) is sequentially solidified. Thus, crystals are grown into a columnar shape (a needle-like shape) from the roll contact face in the thickness direction. As a result, the rapidly solidified alloy has a fine-crystal structure including an $R_2T_{14}Q$ crystal phase having a short axis size of not smaller than 3 μm nor larger than 10 μm and a long axis size of not smaller than 10 μm nor larger than 300 μm, and an R-rich phase (a phase in which the concentration of a rare earth element R is relatively high) which dispersedly exists in a grain boundary of the $R_2T_{14}Q$ crystal phase. The R-rich phase is a nonmagnetic phase in which the concentration of the rare earth element R is relatively high, and the thickness thereof (corresponding to the width of the grain boundary) is 10 μm or less.

The rapidly solidified alloy is cooled in a relatively short time, so that the structure is made to be fine and a crystal grain size is small, as compared with an alloy (an ingot alloy) prepared by a conventional ingot casting method (a mold casting method). In addition, an area of the grain boundary is wide because crystal grains are finely dispersed, and the R-rich phase is superior in dispersibility because the R-rich phase is thinly spread in the grain boundary, so that the degree of sintering is improved. Therefore, in the case where an R-T-Q rare earth sintered magnet with superior properties is to be produced, the rapidly solidified alloy is used as the material.

In the case where a hydrogen gas is once occluded in a rare earth alloy (especially in a quenched alloy), and the coarse pulverization is performed by a so-called hydrogen pulverization process (in this specification, such a pulverization method is referred to as "a hydrogen decrepitation process"), an R-rich phase positioned in a grain boundary reacts with hydrogen, and expanded, so that cracks tend to occur from a portion of the R-rich phase (the grain boundary portion). Therefore, the R-rich phase frequently appears in a grain surface of powder obtained by the hydrogen pulverization of the rare earth alloy. In the case of the rapidly solidified alloy, the R-rich phase is made to be fine, and the dispersibility is high, so that the R-rich phase is especially exposed in the surface of the power obtained by hydrogen pulverization.

The above-described pulverization method by means of the hydrogen decrepitation process is disclosed in U.S. Pat. No. 6,403,024 which is incorporated in this specification.

In a known technique, in order to increase the coercive force of such an R-T-Q rare earth magnet, Dy, Tb, and/or Ho is substituted for part of rare earth element R. In this specification, at least one element selected from the group consisting of Dy, Tb, and Ho is denoted by $R_H$.

However, the element $R_H$ added to a material alloy for an R-T-Q rare earth magnet uniformly exists not only in an $R_2T_{14}Q$ phase as a main phase but also in a grain boundary phase, after the rapid solidification of molten alloy. The element R existing in the grain boundary phase involves a problem that the element $R_H$ does not contribute to the increase in the coercive force.

There is another problem that the existence of a lot of element $R_H$ in the grain boundary deteriorates the degree of sintering. The problem is serious when the ratio of the element $R_H$ in the material alloy is 1.5 at % or more, and the problem is remarkable in the case where the ratio is 2.0 at % or more.

A grain boundary phase portion of the rapidly solidified alloy is easily made into super fine powder (particle diameter: 1 μm or less) by the hydrogen decrepitation process and the fine pulverization process. Even if the portion is not made into fine powder, an exposed powder surface can be easily constructed. Such super fine powder may easily cause problems of oxidation and ignition, and badly affect the sintering, so that the super fine powder is removed during the pulverization process. The rare earth element exposed on the surface of a powder grain having a particle diameter of 1 μm or more is easily oxidized. In addition, the element $R_H$ is easily oxidized, as compared with Nd and Pr, so that the element $R_H$ existing in the grain boundary phase of the alloy forms a stable oxide and is not substituted for the rare earth element R as the main phase. Thus, a segregated condition is easily maintained in the grain boundary phase.

As described above, there is a problem that, in the element $R_H$ in the quenched alloy, a portion existing in the grain boundary phase is not effectively used for the purpose of improving the coercive force. The element $R_H$ is a rare element, and is expensive. For these reasons, in views of the effective use of the resources and the reduction in production cost, it is strongly required that the above-mentioned waste is avoided.

Japanese Laid-Open Patent Publication No. 61-253805 discloses a technique in which Dy is added in the form of an oxide, and the Dy is dispersed in a surface of the main phase during the sintering, so that high coercive force can be obtained with a small amount of Dy. According to the technique, however, a Dy oxide which does not contribute to the coercive force remains in the grain boundary phase, so that the use amount of Dy cannot be sufficiently reduced.

Japanese Laid-Open Patent Publication No. 3-236202 discloses a technique in which Sn is added, in addition to Dy, so that Dy existing in the grain boundary phase is concentrated into the main phase. The technique, however, involves a problem that the existence ratio of the main phase is lowered due to the existence of Sn which does not contribute to the magnetic properties, thereby lowering the saturation magnetization. In addition, the Dy remains in the grain boundary phase as an oxide, so that the effect that Dy is concentrated into the main phase is little.

A technique in which the coercive force is improved by adding Al, Cu, Cr, Ga, Nb, Mo, V, or the like without using any heavy rare earth element such as Dy, Tb, or Ho is conventionally proposed. However, the addition of any of the elements results in the generation of a phase which does not contribute to the magnetic properties, so that there exist problems such as that the saturation magnetization is lowered, or that the magnetization of the main phase is lowered.

Japanese Laid-Open Patent Publication No. 5-33076 discloses a technique in which thermal treatment at temperatures of not lower than 400° C. nor higher than 900° C. is performed for an alloy cast block, so that the aligning direction of the main phase crystals are directed to a specified orientation.

Japanese Laid-Open Patent Publication No. 8-264363 discloses a technique in which after thermal treatment at temperatures of not lower than 800° C. nor higher than 1100° C. is performed for an alloy produced by a strip casting method, grain distribution after pulverization is improved, so that the magnetic properties are improved. However, if the thermal treatment at such temperatures is performed, the fine structure which is an advantage of the strip casting method is lost, so that the coercive force is lowered in the case where the grain distribution of powder is the same. It is considered that the degree of sintering is also lowered.

Japanese Laid-Open Patent Publication No. 10-36949 discloses a technique in which, when a molten alloy is cooled by the strip casting method, the cooling speed is limited to be 1° C./min. or less in the temperature range in which the alloy temperature lowers from 800° C. to 600° C., so as to perform slow cooling. According to this method, it is described that the ratio of main phase is increased, and the residual magnetization of the sintered magnet is improved. However, the improvement in coercive force is not described.

According to the experiments of the inventors, it was found that, especially when a rapidly solidified alloy was produced by rapidly solidifying a molten alloy, much existed in the grain boundary phase. It is considered that the phenomenon occurs because the solidifying process of the molten alloy is completed before the element $R_H$ is fallen in a lattice position (site) of the rare earth element R in the main phase. Accordingly, if the hydrogen decrepitation process is performed before the rapidly solidified alloy produced by the strip casting method or the like is finely pulverized, a lot of element $R_H$ existing in the grain boundary phase is wastefully lost. Thus, there is a problem that the use efficiency of the element $R_H$ is further lowered. In addition, when the element $R_H$ included in the alloy in the grain boundary phase is increased, the degree of sintering is lowered, so that it is necessary to increase the sintering temperature.

The present invention has been conducted in view of the above-described prior-art. A main object of the present invention is to provide an R—Fe-Q rare earth magnet with effectively improved coercive force while Dy, Tb, and Ho is effectively used.

Another objective of the present invention is to provide a production method of a material alloy for an R—Fe-Q rare earth magnet, and powder thereof, and a production method of a sintering magnet using the alloy powder.

DISCLOSURE OF INVENTION

The rare earth permanent magnet of the present invention is a rare earth permanent magnet containing an $R_2T_{14}Q$ phase (R is a rare earth element, T is a transition metal element, and Q is at least one element selected from the group consisting of B, C, N, Al, Si, and P) as a main phase, wherein the rare earth element contains at least one kind of element $R_L$ selected from the group consisting of Nd and Pr, and at least one kind of element $R_H$ selected from the group consisting of Dy, Tb, and Ho, the element $R_H$ accounts for 10 at % or more of the total of the contained rare earth element, and a mole fraction of the element $R_H$ included in the $R_2T_{14}Q$ phase is larger than a mole fraction of the element $R_H$ in the total of the contained rare earth element.

In a preferred embodiment, the mole fraction of the element $R_H$ included in the $R_2T_{14}Q$ phase is larger than 1.1 times of the mole fraction of the element $R_H$ in the total of the contained rare earth element.

In a preferred embodiment, the rare earth element R is 11 at % or more and 17 at % or less of the total, the transition metal element T is 75 at % or more and 84 at % or less of the total, and the element Q is 5 at % or more and 8 at % or less of the total.

In a preferred embodiment, the rare earth permanent magnet further contains at least one additive element M selected from the group consisting of Ti, V, Cr, Mn, Ni, Cu, Zn, Ga, Zr, Nb, Mo, In, Sn, Hf, Ta, W, and Pb.

The material alloy for an R-T-Q rare earth permanent magnet of the present invention is a material alloy for the R-T-Q rare earth permanent magnet containing an $R_2T_{14}Q$ phase (R is a rare earth element, T is a transition metal element, and Q is at least one element selected from the group consisting of B, C, N, Al, Si, and P) as a main phase, wherein the rare earth element contains at least one kind of element $R_L$ selected from the group consisting of Nd and Pr, and at least one kind of element $R_H$ selected from the group consisting of Dy, Tb, and Ho, the $R_2T_{14}Q$ phase is a needle-like crystal having a size in a short axis direction of not less than 3 μm nor more than 10 μm, and a size in a long axis direction of not less than 10 μm nor more than 300 μm, and the element $R_H$ accounts for 10 at % or more of the total of the contained rare earth element, and a concentration of the element $R_H$ in the $R_2T_{14}Q$ phase is higher than a concentration of the element $R_H$ in phases other than the $R_2T_{14}Q$ phase. The material alloy preferably includes the $R_2T_{14}Q$ phase at 80 vol % or more.

The production method of the present invention is a production method of a material alloy for an R-T-Q rare earth magnet comprising: a step of preparing a molten alloy of an R-T-Q rare earth alloy (R is a rare earth element, T is a transition metal element, and Q is at least one element selected from the group consisting of B, C, N, Al, Si, and P), the rare earth element R containing at least one kind of element $R_L$ selected from the group consisting of Nd and Pr, and at least one kind of element $R_H$ selected from the group consisting of Dy, Tb, and Ho; a cooling step of rapidly solidifying the molten alloy, thereby producing a rapidly solidified alloy; and a thermal treatment step of holding the quenched and solidified alloy in a temperature range of 400° C. or higher and lower than 800° C. for a period of not shorter than 5 minutes nor longer than 12 hours.

In a preferred embodiment, the cooling step including a step of cooling the molten alloy by using a rotating cooling roll.

In a preferred embodiment, the cooling step includes a step of cooling the molten alloy at a cooling speed of not lower than $10^{1\circ}$ C./sec. nor higher than $10^{4\circ}$ C./sec.

In a preferred embodiment, the cooling step is performed by a strip casting method.

The production method of the present invention is a production method of material alloy powder for an R-T-Q rare earth magnet comprising the steps of: embrittling a material alloy for the R-T-Q based rare earth magnet produced by the above-decribed production method by a hydrogen decrepitation method; and pulverizing the embrittled material alloy for the R-T-Q based rare earth magnet.

In a preferred embodiment, in the step of pulverizing the R-T-Q rare earth magnet, fine pulverization of the R-T-Q rare earth magnet is performed by using a high-speed flow of an inert gas.

In a preferred embodiment, a concentration of the oxygen is adjusted to be not lower than 0.05 vol. %, nor higher than 3 vol. %.

The production method of the present invention is a production method of a sintered magnet comprising the steps of: producing a compaction of the material alloy powder for the R-T-Q rare earth magnet produced by the above-described production method; and sintering the compaction.

In a preferred embodiment, the material alloy powder for the R-T-Q rare earth magnet is constituted by a plurality of kinds of material alloy powders including different contents of rare earth element R.

BEST MODE FOR CARRYING OUT THE INVENTION

Figure 1:
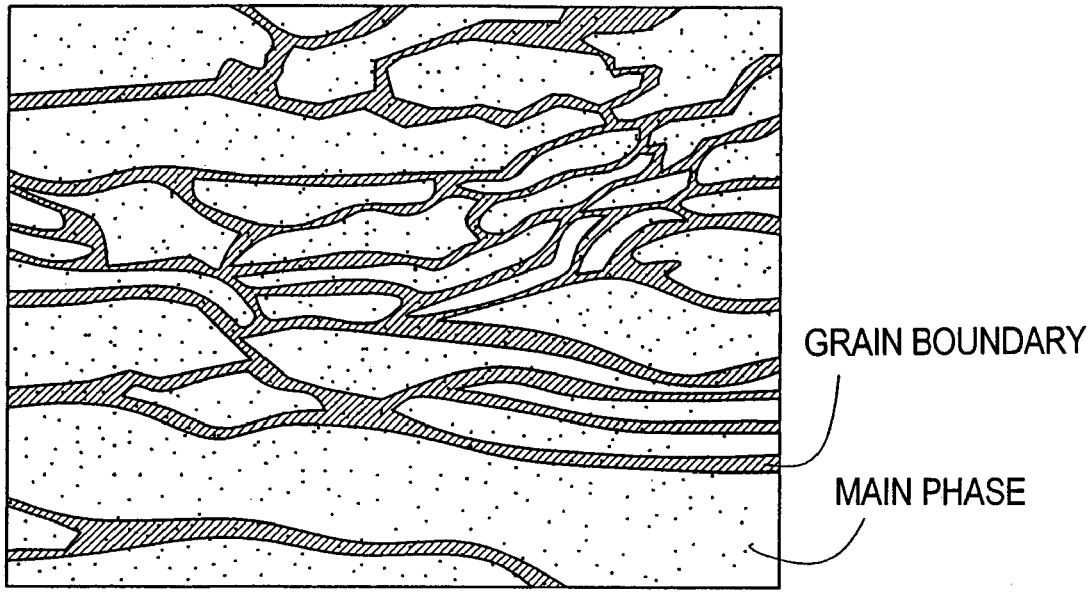
FIG. 1 is a schematic diagram illustrating a structure of a rapidly solidified alloy (alloy A)

In the present invention, first, a molten alloy of an R-T-Q rare earth alloy (R is a rare earth element, T is a transition metal element, and Q is at least one element selected from the group consisting of B, C, N, Al, Si, and P) is prepared. The R-T-Q rare earth alloy contain, as the rare earth element R, at least one kind of element $R_L$ selected from the group consisting of Nd and Pr, and at least one kind of element $R_H$ selected from the group consisting of Dy, Tb, and Ho. Next, the molten alloy having the above-mentioned composition is rapidly solidified, so as to produce a rapidly solidified alloy.

The inventors of the present invention found that the element $R_H$ positioned in the grain boundary phase of the rapidly solidified alloy was moved into the main phase by holding the rapidly solidified alloy in the temperature range of 400° C. or higher and lower than 800° C. for a period of not shorter than 5 minutes nor longer than 12 hours, so that the element $R_H$ could be concentrated in the main phase, and the inventors invented the present invention.

According to the experiments of the inventors, in order to move element $R_H$ from the grain boundary phase to the main phase in a relatively low temperature range of 400° C. or higher and lower than 800° C., it is necessary that the structure of the rapidly solidified alloy is fine. It is preferred that the rapidly solidified alloy having such a fine structure be produced by cooling a molten alloy at a speed of not lower than $10^{1\circ}$ C./sec. nor higher than $10^{4\circ}$ C./sec. by means of a rapidly solidifying method such as a strip casting method. More preferably, the rapidly solidifying speed is $10^{2\circ}$ C./sec. or higher. The production method of a quenched alloy by the strip casting method is disclosed in U.S. Pat. No. 5,383,978, which is incorporated in this specification.

Conventionally, it was tried that thermal treatment at high temperatures for a long time was performed for an alloy produced by an ingot method, so as to reduce an amount of unnecessary α-Fe existing in the alloy. However, the alloy produced by the rapidly solidifying method such as the strip casting method included almost no α-Fe, so that such thermal treatment was not required. In addition, the rapidly solidified alloy had an advantage that the crystal structure was fine, as compared with the ingot alloy. Thus, there existed a technical common sense that the thermal treatment which might cause the crystal structure to be coarse was not preferable for the rapidly solidified alloy.

The inventors were free from such a technical common sense, and found that thermal treatment in an appropriate temperature range could concentrate element $R_H$ existing in the grain boundary into the main phase, so as to efficiently improve the coercive force.

According to the experiments by the inventors, in order to improve the coercive force, it was found that it was extremely important to control the oxygen concentration in an atmosphere when the rapidly solidified alloy was pulverized. Especially when the hydrogen decrepitation process is performed before the fine pulverization process, the fine pulverization process is preferably performed in an inert gas because the grain boundary phase portion is easily exposed on the powder surface, and the oxygen concentration in the inert gas is preferably adjusted to be 1 vol. % or less. If the oxygen concentration in the atmospheric gas becomes high so as to exceed 1 vol. %, the powder grains are oxidized during the fine pulverization process, and part of the rare earth elements is disadvantageously consumed for the generation of oxide. If a lot of rare earth oxides which do not contribute to the magnetic properties are generated in the material alloy powder for the rare earth magnet, the existence ratio of the $R_2T_{14}Q$ based crystal phase as the main phase is lowered, so that the magnetic properties are deteriorated. In addition, an oxide of the element $R_H$ is easily generated in the grain boundary, so that the concentration of the element $R_H$ in the main phase is lowered. p Such fine pulverization can be performed by using a pulverization apparatus such as a jet mill, an attriter, or a ball mill. The pulverization by a jet mill is disclosed in U.S. Pat. No. 6,491,765 which is incorporated in this specification.

Hereinafter preferred embodiments of the present invention will be described.

First, a molten alloy of R-T-Q rare earth alloy is prepared. The rare earth element R contains at least one kind of element $R_L$ selected from the group consisting of Nd and Pr, and at least one kind of element $R_H$ selected from the group of Dy, Tb, and Ho. In order to attain an effect of sufficiently improving the coercive force, the mole fraction (mole ratio) of element $R_H$ in the whole of the rare earth element is set to be 10% or more.

In a preferred embodiment, the content of the rare earth element R is not less than 11 at % nor more than 17 at % of the whole of the alloy. The element $R_H$ which contributes to the improvement in the coercive force accounts for 10 at % or more of the whole of the rare earth element R.

The transition metal element T includes Fe as a main component (50 at % or more of the total of T), and the residual portion may include a transition metal element Co and/or Ni, or the like. The content of the transition metal element T is not less than 75 at % nor more than 84 at % of the whole of the alloy.

The element Q contains B as a main component, and may contain at least one element selected from the group consisting C, N, Al, Si, and P which can be substituted for B (boron) in an $Nd_2Fe_{14}B$ crystal structure of tetragonal system. The content of the element Q is not less than 5 at % nor more than 8 at % of the whole of the alloy.

To the alloy, at least one additive element M selected from the group consisting of Ti, V, Cr, Mn, Ni, Cu, Zn, Ga, Zr, Nb, Mo, In, Sn, Hf, Ta, W, and Pb may be added, in addition to the above-mentioned main elements.

The molten alloy of the material alloy having the above-mentioned composition is brought into contact with a surface of a cooling roll of a strip casting apparatus, so as to rapidly solidify the molten alloy. A preferred range of the rotation speed (a surface peripheral velocity) of the cooling roll is not lower than 0.3 m/sec. nor higher than 10 m/sec. Accordingly, the molten alloy can be quenched at a cooling speed of not lower than $10_1$° C./sec. nor higher than $10^{4}$° C./sec.

In the rapidly solidified alloy (the strip cast alloy) which is prepared in the above-described manner, an $R_2T_{14}Q$ phase is formed as a main phase (R is a rare earth element, T is a transition metal element, and Q is at least one element selected from the group consisting of B, C, N, Al, Si, and P). The $R_2T_{14}Q$ phase is a needle-like crystal having a size in a short axis direction of not smaller than 3 μm nor larger than 10 μm, and having a size in a long axis direction of not smaller than 10 μm nor larger than 300 μm. In a condition immediately after the rapidly solidifying (as-spun), the concentration of the element $R_H$ in the $R_2T_{14}Q$ phase is substantially at the same level as the concentration of the element $R_H$ in other phases than the $R_2T_{14}Q$ phase (such as a grain boundary phase).

Next, for the rapidly solidified alloy obtained by the strip casting method, thermal treatment process in which the alloy is held at temperatures in the range of 400° C. or higher and lower than 800° C. for a period of time of not shorter than 5 minutes nor longer than 12 hours is performed. A preferred temperature range of the thermal treatment is not lower than 400° C. nor higher than 700° C., and a more preferably temperature range is not lower than 500° C. nor higher than 650° C. The thermal treatment is preferably performed in such a manner that the material alloy which is once cooled to a temperature at which the dispersion of element does not occur (about 300° C., for example) is heated again in a furnace other than the rapidly solidifying apparatus.

By way of the above-mentioned thermal treatment, the element $R_H$ existing in the grain boundary phase is moved to the $R_2T_{14}Q$ phase as the main phase, and concentrated in the $R_2T_{14}Q$ phase. As a result, in the obtained alloy, the concentration of the element $R_H$ in the $R_2T_{14}Q$ phase is higher than the concentration of the element $R_H$ in other phases than $R_2T_{14}Q$ phase.

Next, the alloy after the thermal treatment is embrittled by a hydrogen decrepitation method. Thereafter, the alloy is pulverized into fine powder by using a pulverization apparatus such as a jet mill. An average particle size (FSSS particle size) of the obtained dry-type powder is about 3.0 to 4.0 μm. In the jet mill, the material alloy is pulverized by using high-speed flow of an inert gas into which a predetermined amount of oxygen is introduced. The oxygen concentration in the inert gas is preferably adjusted to be 1 vol. % or less. More preferably, the oxygen concentration is 0.1 vol. % or less.

In the present invention, the reason why the oxygen concentration in the atmosphere for the pulverization is limited is that the element $R_H$ moved from the grain boundary phase to the main phase is not moved again to the grain boundary phase portion nor deposited there by the oxidation. If a lot of oxygen is included in the powder, the heavy rare earth element $R_H$ such as Dy, Tb, and Ho is tend to be coupled with oxygen so as to generate a stable oxide. In the alloy structure used in the present invention, oxygen is more distributed in the grain boundary phase than in the main phase. Therefore, it is considered that element $R_H$ in the main phase is dispersed again to the grain boundary phase, and consumed for the generation of oxide. If element $R_H$ flows out of the main phase, the sufficient improvement in the coercive force cannot be realized, so that in the pulverization process and a sintering process which will be described next, it is desired that the oxidation of powder be appropriately suppressed.

Next, by using a powder press apparatus, the powder is compressed in an alignment magnetic field, so as to form a desired shape. The thus-obtained powder compaction is sintered in an inert gas atmosphere of not lower than $10^{-4}$ Pa nor more than $10^{6}$ Pa. It is desired that the sintering process is performed in the atmosphere in which the oxygen concentration is limited to be a predetermined level or less, so that the oxygen concentration included in a sintered body (a sintered magnet) is 0.3 mol % or less.

EMBODIMENTS

Figure 2:
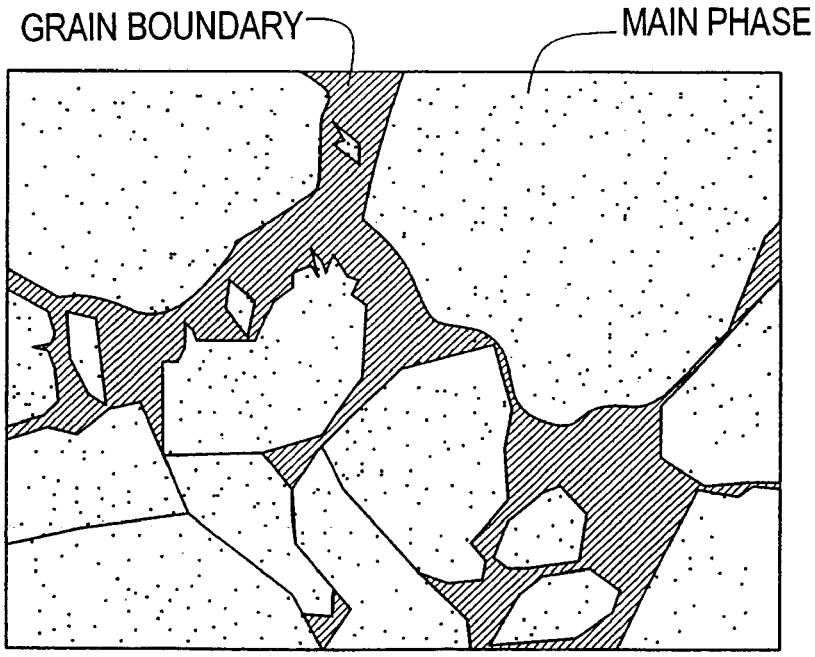
FIG. 2 is a schematic diagram illustrating a structure of an ingot alloy (alloy B).

First, a molten alloy having a composition of 22% Nd-10% Dy-0.25% Al-0.05% Cu-1.0% B-the residual portion Fe in mass ratios was rapidly solidified by a strip casting method, so as to produce a quenched and solidified alloy with the above-mentioned composition (alloy A). As a relative example, an alloy (alloy B) was produced by an ingot method. FIG. 1 and FIG. 2 are schematic diagrams showing structures of the alloy A and the alloy B, respectively. In the attached figures, Dy is schematically shown as dots. As shown in FIG. 1, in the alloy A, Dy uniformly exists in the main phase and the grain boundary phase. As is seen from the comparison between FIG. 1 and FIG. 2, the amount of Dy existing in the grain boundary phase is larger in the alloy A than in the alloy B.

Figure 3:
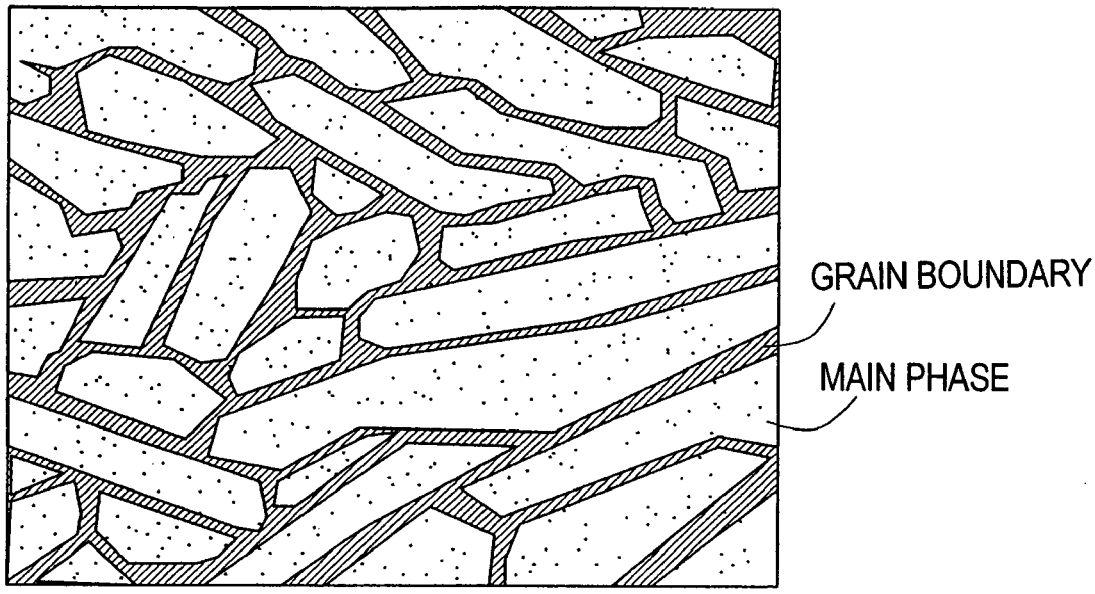
FIG. 3 is a diagram illustrating an alloy structure after thermal treatment at 600° C. for 1 hour is performed for the quenched alloy (alloy A) in an Ar atmosphere.
Figure 4:
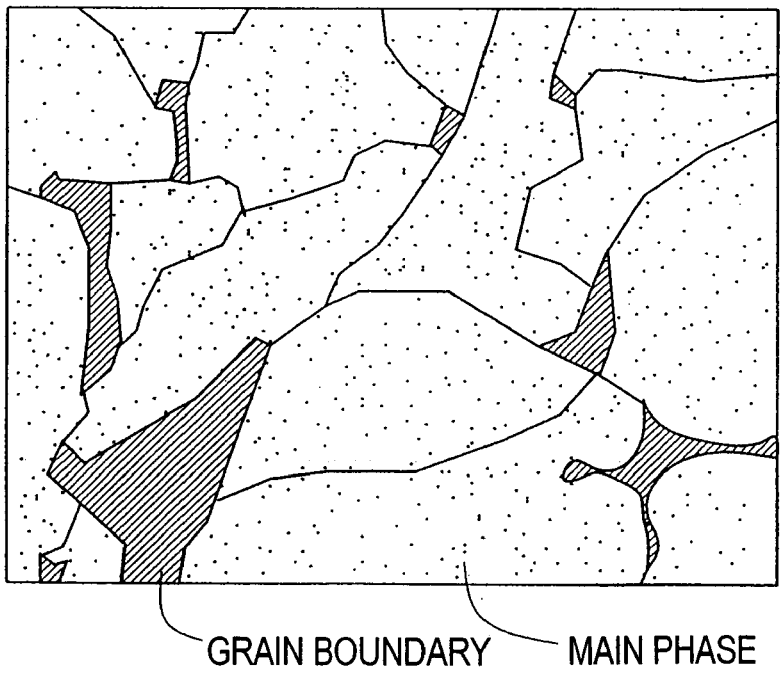
FIG. 4 is a diagram illustrating an alloy structure after thermal treatment at 600° C. for 1 hour is performed for the ingot alloy (alloy B) in an Ar atmosphere.

Next, for the alloys A and B, thermal treatment at 600° C. for 1 hour was performed in an Ar atmosphere. Structures of the alloys before and after the thermal treatment are shown in FIG. 3 and FIG. 4, respectively. As shown in FIG. 3 and FIG. 4, in the alloy A, the concentration of Dy existing in the grain boundary phase is lowered. This is because Dy existing in the grain boundary phase is moved to the main phase by the thermal treatment, and concentrated in the main phase.

Figure 5:
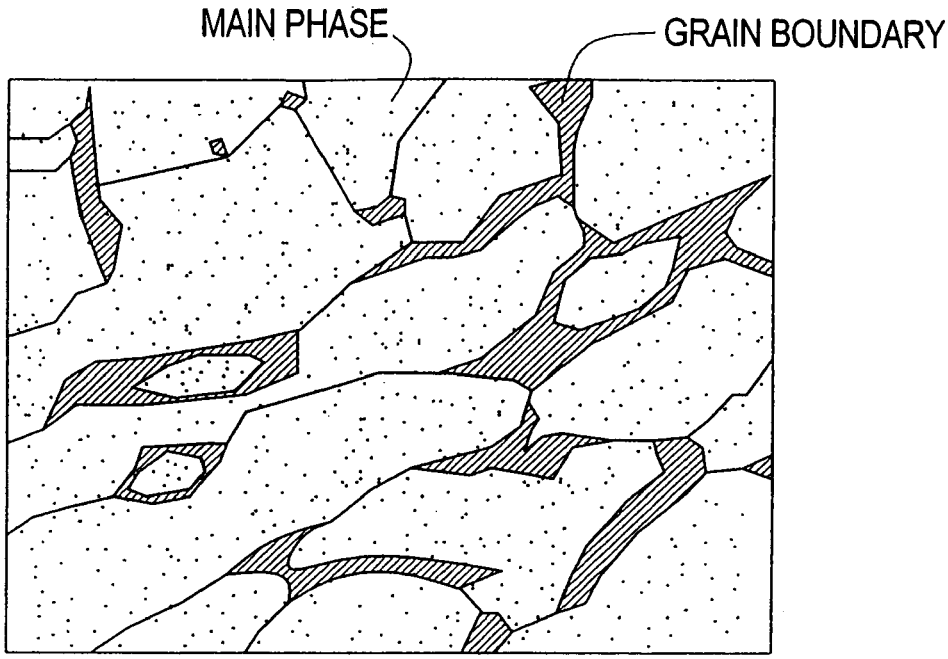
FIG. 5 is a diagram illustrating an alloy structure after thermal treatment at 800° C. for 1 hour is performed for the quenched alloy (alloy A) in an Ar atmosphere.

For reference purposes, for the alloy A, thermal treatment at 800° C. for 1 hour was performed in an Ar atmosphere. In this case, as shown in FIG. 5, Dy is moved from the grain boundary phase to the main phase, and concentrated in the main phase. However, the size of crystal grains constituting the main phase is increased to some extent.

Next, after the hydrogen decrepitation process (coarse pulverization) was performed for the alloys, fine pulverization of airflow type using a jet mill was performed, so as to produce alloy powder. The pulverizing atmosphere in the jet mill was a nitrogen gas, and the oxygen concentration in the pulverization atmosphere was adjusted to be 0.1 vol. % or less. Thereafter, with a powder press apparatus, the alloy powder was compressed and compacted in an alignment magnetic field, so as to produce a compacted body of alloy powder. Thereafter, for the powder compaction, vacuum sintering and aging treatment were performed, so as to manufacture a sintered magnet.

Figure 6:
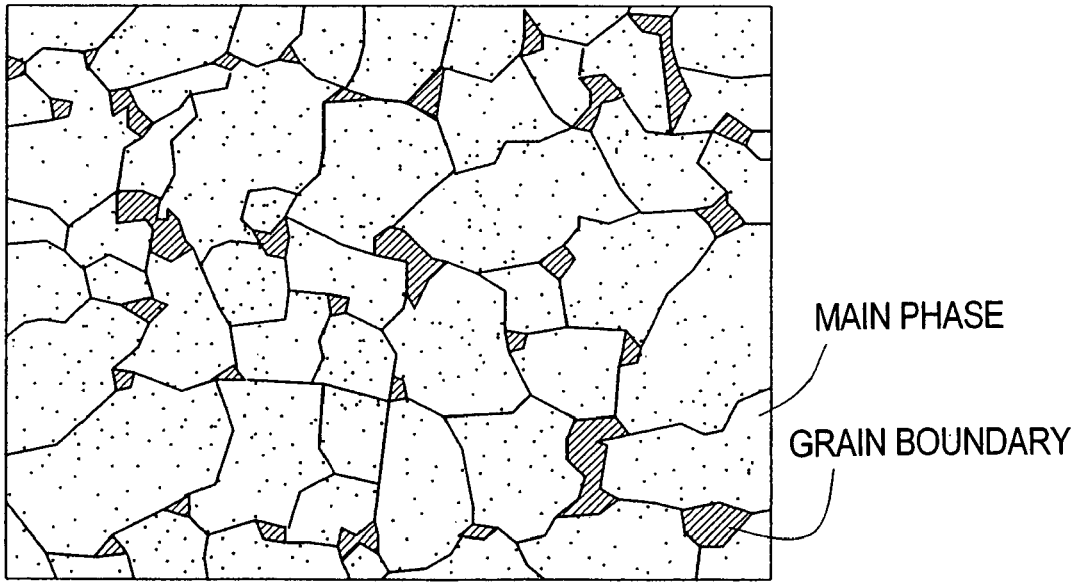
FIG. 6 is a diagram illustrating a structure of a sintered magnet produced from powder of the rapidly solidified alloy (alloy A) for which the thermal treatment at 600° C. for 1 hour is performed.

FIG. 6 shows a structure of a sintered magnet manufactured from the powder of the alloy A. As is seen from the figure, Dy is still concentrated in the main phase.

Figure 7:
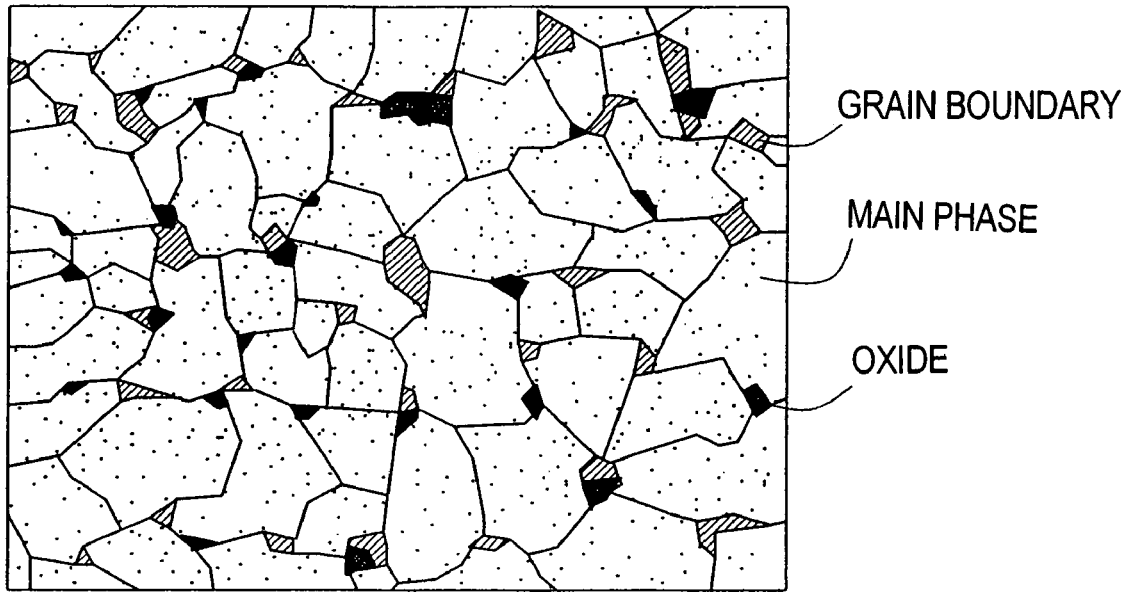
FIG. 7 is a diagram illustrating a structure of a sintering magnet produced from powder of the rapidly solidified alloy (alloy A) for which the thermal treatment at 600° C. for 1 hour is omitted, as a comparative example.

On the other hand, as a comparative example, a structure of a sintered magnet manufactured from the alloy A for which the thermal treatment at 600° C. for 1 hour is omitted is shown in FIG. 7. As is seen from the figure, an oxide is generated in the grain boundary phase. In the oxide, a relatively large amount of Dy which is oxidized exists, so that the Dy concentration in the main phase is lowered.

Table 1 shows composition ratios (mass ratios) of the alloy in the following respective stages, in respective elements included in the alloy A for which the thermal treatment at 600° C. for 1 hour is performed.

Material alloy before hydrogen decrepitation process

Alloy powder immediately after fine pulverization process by a jet mill

Sintered body after the completion of sintering process

TABLE 1

| | Nd | Pr | Dy | Fe | Co | Cu | Al | B | O |
|---|---|---|---|---|---|---|---|---|---|
| Material | 17.5 | 5.04 | 9.82 | 64.3 | 0.91 | 0.05 | 0.25 | 1.01 | 0.03 |
| After Fine Pulverization | 17.1 | 4.90 | 9.90 | 64.8 | 0.90 | 0.05 | 0.25 | 1.00 | 0.26 |
| Sintered Body | 17.0 | 4.90 | 9.90 | 64.9 | 0.91 | 0.05 | 0.25 | 1.00 | 0.28 |

From Table 1, it is found that the ratio of Dy in the conditions after the fine pulverization and after the sintering is increased, as compared with the ratio before the pulverization. This means the following. Since the grain boundary phase of the material alloy is removed out of powder as ultra-fine powder particles during the fine pulverization process, part of Nd and Pr positioned in the grain boundary phase is eliminated. On the contrary, Dy concentrated into the main phase from the grain boundary phase is excluded from such elimination, so that the content ratio is relatively increased.

The magnetic properties of the sintered body shown in Table 1 are shown in Table 2.

TABLE 2

| $B_r$ (T) | $H_{CB}$ (kA/m) | $H_{CJ}$ (kA/m) | $(BH)_{max}$ (kJ/m$^3$) |
|---|---|---|---|
| 1.118 | 879.1 | 2347 | 245.3 |

The constituting ratio of the rare earth element in the main phase in the sintered body and the constituting ratio of the rare earth element in the whole of the sintered body are shown in Table 3.

TABLE 3

| | Nd | Pr | Dy |
|---|---|---|---|
| Main Phase | 53.15 | 13.31 | 33.53 |
| Total | 55.18 | 16.28 | 28.52 |

Herein, in the rare earth element included in the main phase, a mole fraction of Dy is denoted by $N_m$, and a mole fraction of Dy in the rare earth element included in the total of the sintered magnet is denoted by $N_t$. In the example shown in Table 3, $N_m/N_t$ is 1.17, and it is seen that Dy is concentrated in Dy. It is preferred that $N_m/N_t$ be 1.15 or more.

The mole fraction of Dy in the main phase ($N_m$) is a value obtained by quantitative analysis by means of EPMA. The mole fraction of Dy in the total of the sintered magnet ($N_t$) is a value obtained by chemical analysis.

Table 4 shown below shows, for the alloy A for which the thermal treatment at 600° C. for 1 hour is not performed (comparative example), composition ratios (mass ratios) of the alloy in the following respective stages.

Material alloy before hydrogen decrepitation process
Alloy powder immediately after fine pulverization process by a jet mill
Sintered body after the completion of sintering process

TABLE 4

| | Nd | Pr | Dy | Fe | Co | Cu | Al | B | O |
|---|---|---|---|---|---|---|---|---|---|
| Material | 17.5 | 5.04 | 9.82 | 64.3 | 0.91 | 0.05 | 0.25 | 1.01 | 0.03 |
| After Fine Pulverization | 17.1 | 4.94 | 9.81 | 64.9 | 0.91 | 0.05 | 0.24 | 1.00 | 0.24 |
| Sintered Body | 17.1 | 4.93 | 9.82 | 64.9 | 0.90 | 0.05 | 0.24 | 1.00 | 0.27 |

As is seen from Table 4, after the pulverization process, the composition ratio of Dy is lowered as compared with the composition ratio in the material alloy. The reason why is considered as follows. Since the thermal treatment is omitted, Dy remaining in the grain boundary phase is made into ultra-fine powder particles and removed from the powder by way of the hydrogen decrepitation process and the fine pulverization process.

The magnetic properties of the sintered body shown in Table 4 are shown in Table 5.

TABLE 5

| $B_r$(T) | $H_{CB}$ (kA/m) | $H_{CJ}$ (kA/m) | $(BH)_{max}$ (kJ/m$^3$) |
|---|---|---|---|
| 1.106 | 876.7 | 2220 | 240.5 |

From Table 5, it is found that the magnetic properties (especially the coercive force) of the comparative example are inferior to the magnetic properties shown in Table 2.

The constituting ratio of the rare earth element in the main phase in the sintered body (the comparative example) and the constituting ratio of the rare earth element in the total of the sintered body are shown in Table 6.

TABLE 6

| | Nd | Pr | Dy |
|---|---|---|---|
| Main Phase | 54.09 | 15.02 | 30.89 |
| Total | 55.40 | 16.35 | 28.24 |

From Table 6, it is found that $N_m/N_t$ is less than 1.1, and it is found that Dy is not said that Dy is in a condition where Dy is concentrated in the main phase. In order to say that Dy is concentrated in the main phase, it is necessary that $N_m/N_t$ is 1.1 or more.

All of the above-mentioned results could be obtained in the case where, after pulverization by a jet mill using an inert gas flow with an oxygen concentration adjusted to be 0.1 vol. % or less, the sintering is immediately performed in an environment in which the oxidation of powder is suppressed as much as possible In a comparative example, after fine pulverization by a jet mill, the powder was left in the air for 30 minutes, and the compaction and sintering processes were performed. Measurements which were the same as those described above were carried out for the comparative example. The results will be described below.

Table 7 shown below shows, for respective elements included in the alloy A for which the thermal treatment at 600° C. for 1 hour is performed, composition ratios (mass ratios) of the alloy in the following respective stages.

Alloy powder after it is left in the air
Sintered body after the completion of sintering process

TABLE 7

| | Nd | Pr | Dy | Fe | Co | Cu | Al | B | O |
|---|---|---|---|---|---|---|---|---|---|
| Fine Powder | 16.9 | 4.87 | 9.89 | 64.6 | 0.89 | 0.04 | 0.24 | 0.99 | 0.54 |
| Sintered Body | 16.9 | 4.89 | 9.90 | 64.6 | 0.90 | 0.04 | 0.25 | 1.00 | 0.53 |

From Table 7, it is found that the ratio of oxygen is doubled as compared with the above-described case. The magnetic properties of the sintered body shown in Table 7 are shown in Table 8.

TABLE 8

| $B_r$ (T) | $H_{CB}$ (kA/m) | $H_{CJ}$ (kA/m) | $(BH)_{max}$ (kJ/m$^3$) |
|---|---|---|---|
| 1.101 | 864.2 | 2109 | 237.8 |

As is seen from Table 8, the magnetic properties are deteriorated as compared with the above-described example. The constituting ratio of the rare earth element in the main phase in the sintered body and the constituting ratio of the rare earth element in the total of the sintered body are shown in Table 9.

TABLE 9

| | Nd | Pr | Dy |
|---|---|---|---|
| Main phase | 54.80 | 16.05 | 29.15 |
| Total | 55.06 | 16.31 | 28.63 |

From Table 9, it is found that the mole fraction ($N_m$) of Dy in the contained rare earth element in the main phase is substantially equal to the mole fraction ($N_t$) of Dy in the contained rare earth element in the total of the sintered magnet. From the result, it is considered that the oxygen attached to the surface of the powder particles is considered that the oxygen attached to the surface of the powder particles is coupled with Dy at the grain boundary in sintering, so as to perform the function of dispersing Dy from the main phase to the grain boundary phase. Therefore, even in the case where Dy is concentrated in the main phase by the thermal treatment, if oxidation of Dy progresses in the hydrogen decrepitation process and the fine pulverization process, the Dy concentration in the main phase is disadvantageously lowered. The reduction in the Dy concentration in the main phase also occurs in the case where the fine pulverization is performed in an atmosphere in which the oxygen concentration is not appropriately controlled.

In the present invention, as described above, the oxygen concentration in the fine pulverization process is adjusted in an appropriate range, so that the dispersion of Dy into the grain boundary is suppressed, the improvement in the coercive force can be efficiently achieved.

INDUSTRIAL APPLICABILITY

According to the present invention, among heavy rare earth elements $R_H$ such as Dy added for the purpose of improving the coercive force, element $R_H$ positioned in the grain boundary portion is concentrated in the main phase by means of thermal treatment at relatively low temperatures, and the re-distribution into the grain boundary phase due to the oxidation of the element $R_H$ is suppressed, so that the heavy rare earth element $R_H$ which is rare can be effectively used without any waste, and the coercive force can be effectively improved.

The invention claimed is:

1. A production method of a material alloy for an R-T-Q rare earth sintered magnet comprising:

a step of preparing a molten alloy of an R-T-Q rare earth alloy (R is a rare earth element, T is a transition metal element, and Q is at least one element selected from the group consisting of B, C, N, Al, Si, and P), the rare earth element R containing at least one kind of element $R_L$ selected from the group consisting of Nd and Pr, and at least one kind of element $R_H$ selected from the group consisting of Dy, Tb, and Ho;

a cooling step of rapidly solidifying the molten alloy, thereby producing a rapidly solidified alloy comprising an $R_2T_{14}Q$ crystal phase; and a thermal treatment step of holding the rapidly solidified alloy in a temperature range of 400° C. or higher and lower than 800° C. for a period of not shorter than 5 minutes nor longer than 12 hours.

2. The production method of the material alloy for the R-T-Q based rare earth sintered magnet of claim 1, wherein the cooling step includes a step of cooling the molten alloy by using a rotating cooling roll.

3. The production method of the material alloy for the R-T-Q rare earth sintered magnet of claim 2, wherein the cooling step is performed by a strip casting method.

4. The production method of the material alloy for the R-T-Q rare earth sintered magnet of, wherein the cooling step includes a step of cooling the molten alloy at a cooling speed of not lower than $10^{1}$° C./sec. nor higher than $10^{4}$° C./sec.

5. A production method of material alloy powder for an R-T-Q rare earth magnet comprising the steps of:

preparing a molten alloy of an R-T-Q rare earth alloy (R is a rare earth element, T is a transition metal element, and Q is at least one element selected from the group consisting of B, C, N, Al, Si, and P), the rare earth element R containing at least one kind of element $R_L$ selected from the group consisting of Nd and Pr, and at least one kind of element $R_H$ selected from the group consisting of Dy, Tb, and Ho;

a cooling step of rapidly solidifying the molten alloy, thereby producing a rapidly solidified alloy comprising an $R_2T_{14}Q$ crystal phase;

a thermal treatment step of holding the rapidly solidified alloy in a temperature range of 400° C. or higher and lower than 800° C. for a period of not shorter than 5 minutes nor longer than 12 hours to form a material alloy;

embrittling the material alloy by a hydrogen decrepitation method; and pulverizing the embrittled material alloy for the R-T-Q based rare earth magnet.

6. The production method of the material alloy powder for the R-T-Q rare earth magnet of claim 5, wherein in the step of pulverizing the embrittled material alloy, fine pulverization of the embrittled material alloy is performed by using a high-speed flow of an inert gas.

7. The production method of the material alloy powder for the R-T-Q rare earth magnet of claim 6, wherein a predetermined amount of oxygen is introduced in the inert gas.

8. The production method of the material alloy powder for the R-T-Q rare earth magnet of claim 7, wherein a concentration of the oxygen is adjusted to be 1 vol. % or less.

9. A production method of a sintered magnet comprising the steps of:

preparing a molten alloy of an R-T-Q rare earth alloy (R is a rare earth element, T is a transition metal element, and Q is at least one element selected from the group consisting of B, C, N, Al, Si, and P), the rare earth element R containing at least one kind of element $R_L$ selected from the group consisting of Nd and Pr, and at least one kind of element $R_H$ selected from the group consisting of Dy, Tb, and Ho;

a cooling step of rapidly solidifying the molten alloy, thereby producing a rapidly solidified alloy comprising an $R_2T_{14}Q$ crystal phase;

a thermal treatment step of holding the rapidly solidified alloy in a temperature range of 400° C. or higher and lower than 800° C. for a period of not shorter than 5 minutes nor longer than 12 hours to form a material alloy;

embrittling the material alloy by a hydrogen decrepitation method; and pulverizing the embrittled material alloy to form a material alloy powder for the R-T-Q rare earth magnet;

producing a compaction of the material alloy powder; and sintering the compaction.

10. The production method of the sintered magnet of claim 9, wherein the material alloy powder for the R-T-Q rare earth magnet is constituted by a plurality of kinds of material alloy powders including different contents of rare earth element R.

* * * * *